United States Patent [19]

Vezirian

[11] 3,964,605

[45] June 22, 1976

[54] PROTECTIVE CONTAINER PACKAGE FOR A ROCK DRILL BIT ASSEMBLY

[75] Inventor: Edward Vezirian, Fountain Valley, Calif.

[73] Assignee: Smith International, Inc., Newport Beach, Calif.

[22] Filed: Nov. 1, 1974

[21] Appl. No.: 519,981

[52] U.S. Cl. ..... 206/349; 206/497; 220/353

[51] Int. Cl.[2] ..... B65D 85/54; B65D 65/02; B65D 43/12

[58] Field of Search ..... 206/349, 497, 327, 530, 206/526, 815; 220/353, 352, 4 B, 94 A, DIG. 13, DIG. 12

[56] References Cited

UNITED STATES PATENTS

| | | | |
|---|---|---|---|
| 2,414,171 | 1/1947 | Scharff | 220/DIG. 12 UX |
| 3,152,691 | 10/1964 | Hultgren | 220/352 |
| 3,170,571 | 2/1965 | Knapp et al. | 206/72 |
| 3,244,272 | 4/1966 | Beaman et al. | 220/306 X |
| 3,331,105 | 7/1967 | Gordon | 206/497 X |
| 3,490,582 | 1/1970 | Farquhar | 206/497 X |
| 3,587,904 | 6/1971 | Harris et al. | 220/94 A |
| 3,710,931 | 1/1973 | Hollinger | 206/497 |

FOREIGN PATENTS OR APPLICATIONS

| | | | |
|---|---|---|---|
| 806,158 | 9/1936 | France | 206/501 |
| 820,419 | 11/1951 | Germany | 206/349 |
| 269,366 | 10/1950 | Switzerland | 206/327 |

*Primary Examiner*—Leonard Summer

[57] ABSTRACT

A protective container package including a two piece container assembly with a cavity therein particularly adapted for securely containing a rock drill bit assembly, a shrinkable skin encapsulation envelope shrunk therearound to provide a substantially waterproof enclosed package, and a relatively narrow strap for reinforcingly securing the encapsulated two piece container assembly together with a rock drill bit assembly enclosed therein.

13 Claims, 13 Drawing Figures

Fig. 5.
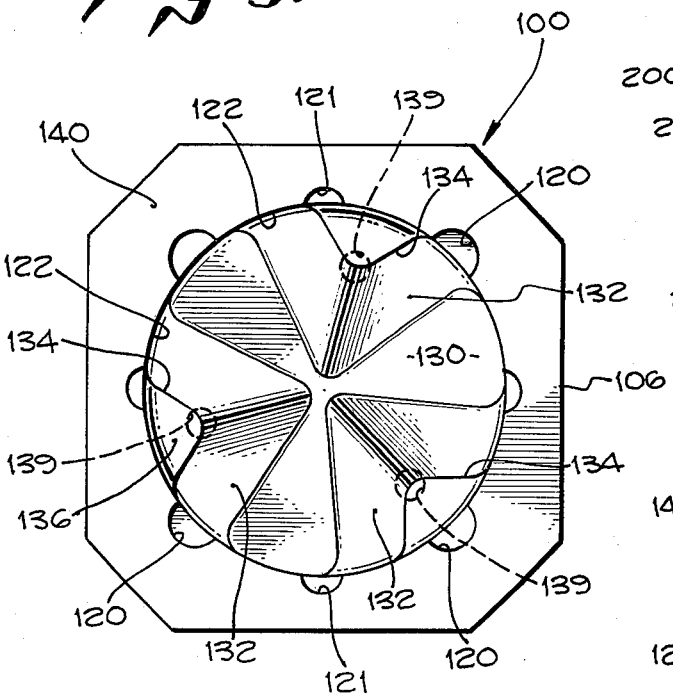
Fig. 7.
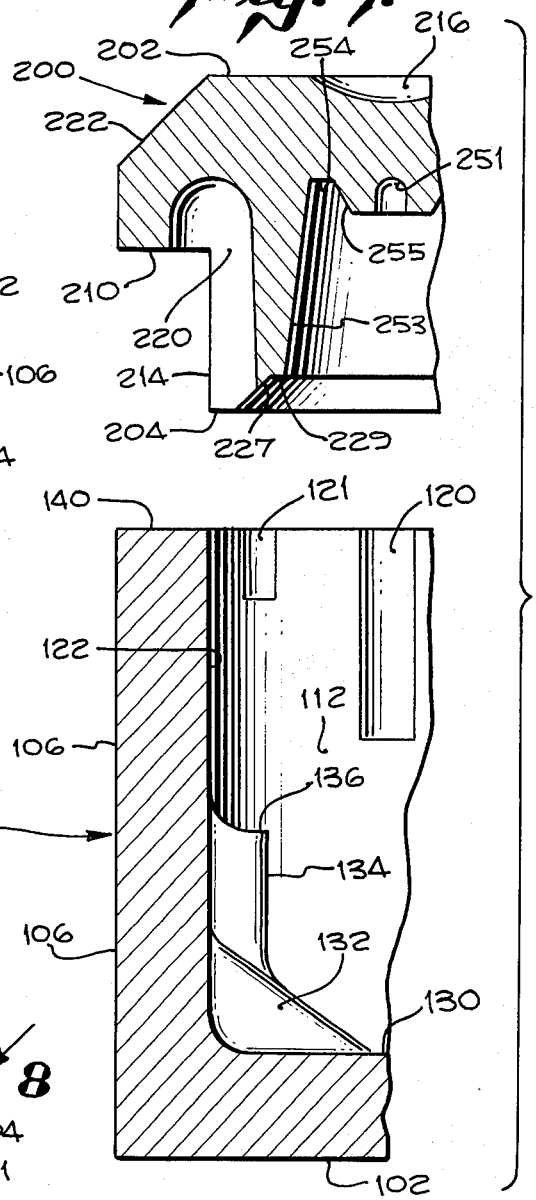
Fig. 6.
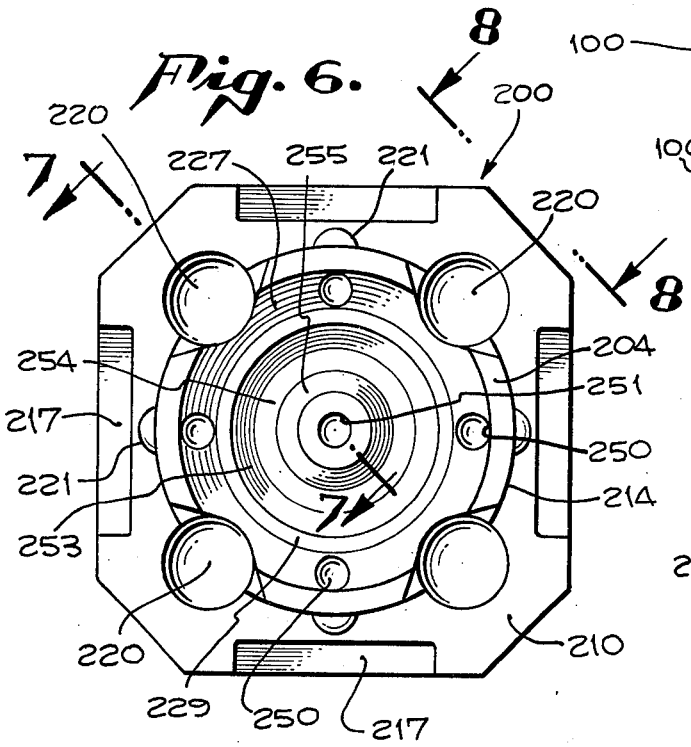
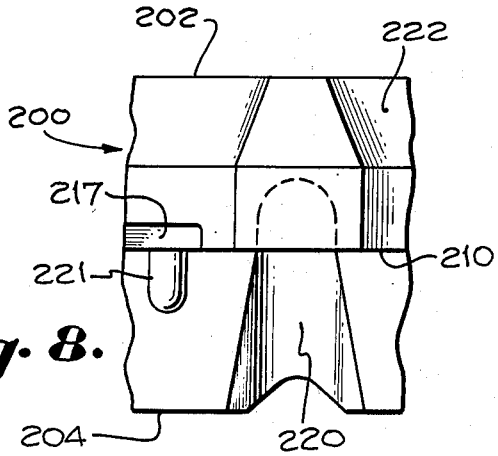
Fig. 8.

PROTECTIVE CONTAINER PACKAGE FOR A ROCK DRILL BIT ASSEMBLY

The container assembly having a boxed shaped lower section with a cover shaped upper section positionally indexed and removably fixed thereto, both sections when mated together forming a defined common cavity therewithin particularly adapted for receiving and retaining a rock drill bit assembly.

The box shaped lower container section has an exterior horizontal bottom based surface with vertical ascending walls integrally attached thereto defining an outer octagonal wall shaped surface with its upper top surface parallel to the horizontal base surface and adapted to receivably seat its mating cover container section, and an internal cavity surface configuration particularly adapted to conformally receive the lower body portion of said rock drill bit assembly.

The mating cover container section has an exterior horizontal top surface parallel to its bottom surface, and a peripheral surface adapted for forming the octagonal exterior portion of the container assembly and vertically stepped for positionally keying with and to be fixedly removable from its mating box container section, as well as having external surface recesses for rapidly separating the cover from the box and for handling ease, and an internal cavity surface adapted to receive the upper body portion of said rock drill bit assembly.

Shrinkable plastic sheet envelope placed over the fully closed container assembly is shrunk conformally over same, thereby providing a substantially waterproof encapsulated package which serves to exclude moisture and abrasives from contact with the enclosed said rock drill bit assembly.

Strapping thereafter applied, as an individual vertical tie band wrapped around the encapsulated package, further reinforces and holds the encapsulated two piece container assembly firmly together, and thus prevents separation of the cover section from its lower box container section which would tend to expose said rock drill bit assembly to potential physical and environmental damage.

BACKGROUND OF THE INVENTION

1. Field of the Invention

This invention pertains to a novel container package, and more particularly, to a protective container package primarily adpated for shipping a rock drill bit assembly.

2. Prior Art

Conventional packaging of a rock drill bit assembly for subsequent shipping or storage has previously consisted of placing the rock drill bit assembly in a wooden or cardboard box containing wooden or plastic inserts to secure and protect the rock drill bit assembly from movement and potential damage during storage or transit. Materials such as wood and cardboard have the inherent characteristic of rapidly absorbing moisture which is deleterious to the ferrous drill bit assembly and bearing elements contained therein. Furthermore, the wood and cardboard shipping container consists of numerous components which makes packaging costly and complex, and this type of packaging material when combined with the weight of the rock drill bit assembly results in a relatively heavy shipping package which increases shipping costs and makes it more difficult to handle the encased rock drill bit assembly.

Oftentimes during transit or storage, the packaged rock drill bit assembly is subject to rain, abrasion, and dirt. Once the conventional cardboard or wooden container is punctured or broken, moisture and dirt enter the package enclosure and both these elements corrode and contaminate the rock drill bit assembly, thereby adversely affecting rock drill bit assembly reliability.

Additionally, cardboard and wooden containers are difficult to handle because of their bulky configuration. Absorption of moisture by the cardboard and the wood container further adds to the weight of the encased rock drill bit assembly. Because the interior of the cardboard or wooden box does not substantially conform to the rock drill bit assembly, there is a tendency for the rock drill bit assembly to move about within the confines of the encased package which, when combined with the bulky configuration and heavy weight, makes handling of the shipping package difficult and dangerous.

Accordingly, the industry has long recognized the need for a new strong, lightweight, weatherproof, easy to handle packaging container adapted for the shipping and the storing of a rock drill bit assembly. The inventor, as an answer to this need, has devised a rock drill bit assembly protective container shipping package with a cavity therein which conforms to the exterior shape of the rock drill assembly and securely restrains it. The protective container package comprises a new two piece container assembly which is relatively lightweight and which is constructed with thin walls where strength is not required so as to reduce package weight, and with substantially thicker wall sections where container strength is required.

After the rock drill bit assembly is enclosed within the two piece container assembly, a shrinkable plastic envelope is placed around the container assembly, and heat is applied to shrink the envelope conformally around the container thereby encapsulating it so as to provide a seal against moisture and dirt and also to protect the rock drill bit assembly from other deleterious environmental elements.

Additionally, a reinforcing strap is wrapped vertically around the encapsulated package to further add strength and also to aid in transporting or lifting the encapsulated rock drill assembly protective package by permitting a person's fingers to be inserted under the strapping to assist in lifting or handling said protective package.

Accordingly, the present invention reduces the weight of the protective shipping container, improves transportability, affords more complete protection of the rock drill bit assembly during shipment and storage, and eliminates reboxing.

SUMMARY OF THE INVENTION

A novel protective container package particularly adapted for a rock drill bit assembly which is lightweight, weatherproof, easy to transport, and of relatively low cost, and which comprises a two piece plastic container with an internal cavity contained therein to conformally receive a rock drill bit assembly, shrinkable plastic sheeting shrunk around said container thereby encapsulating the container with a rock drill bit assembly enclosed therewithin, and a reinforcing strap wrapped around the encapsulated container to further insure against damage to the rock drill bit assembly contained therein.

The protective package is designed to absorb shock loads and to provide support which will prevent the heavy enclosed rock drill bit assembly from punching through the walls of the container assembly if the protective container package is mishandled or dropped.

The inner cavity surface of the container assembly conforms to the outer surface of the rock drill bit assembly with the design intent of preventing rock drill bit assembly movement within the container assembly from developing sufficient inertia so as to cause the rock drill assembly to penetrate the container assembly wall.

The lower box container section and its mating upper cover container section have indexing means to facilitate and to insure correct assembly of the two piece container assembly sections during packaging operations.

Adequate handling means have been provided for ease when transporting the protective container package by incorporating in the exterior container assembly surface a series of recessed areas for easy manual lifting or carrying, and further, a dish shaped depression has been provided in the top exterior cover surface under the reinforcing strapping whereby a person can easily grasp the strap and use same for lifting or carrying the protective container package.

Indexing means molded into the respective box and cover sections positionally index and align the cover and box sections in proper mating relationship so as to facilitate assembly, and also to prevent rotation of the container sections if damage to the protective container package occurred during shipping or storage.

Although the invention is described with particularity in the appended claims, a more complete understanding of the invention may be obtained from the following detailed description of various specific embodiments taken in conjunction with the appended drawings herein.

BRIEF DESCRIPTION OF THE DRAWINGS

FIG. 5 is a top view of the box container section of the preferred embodient.

FIG. 6 is a bottom view of the cover container section of the preferred embodiment.

FIG. 7 consists of respective cross-sectional side views of the box and cover container sections of the preferred embodiment showing molding relief areas, as referenced in FIG. 6, Section 7—7.

FIG. 8 is a fragmentary side view of the cover container section of the preferred embodiment showing a typical molding relief area, as referenced in FIG. 6, view 8—8.

PREFERRED EMBODIMENT

Figure 1:
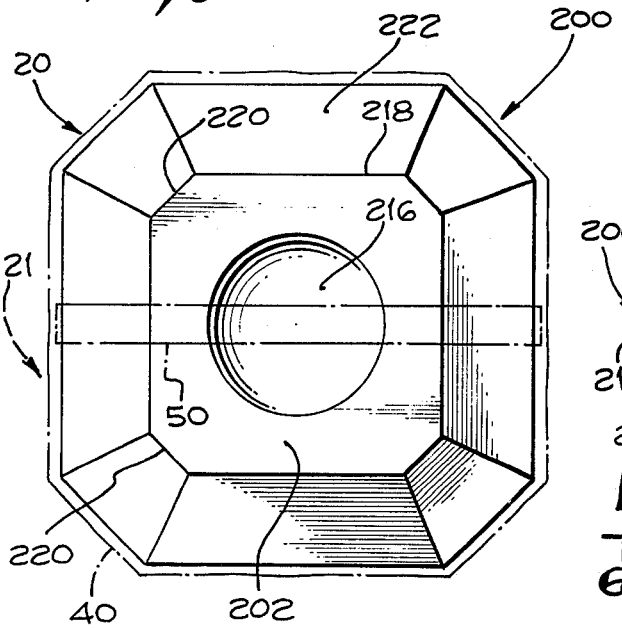
FIG. 1 is a top view of the preferred embodiment of the protective container package.
Figure 3:
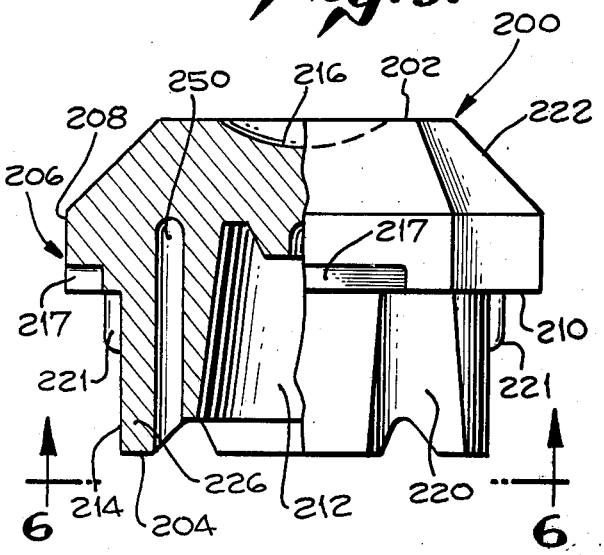
FIG. 3 is a side view of the cover container section of the preferred embodiment including a fragmentary cross-sectional area thereof.
Figure 2:
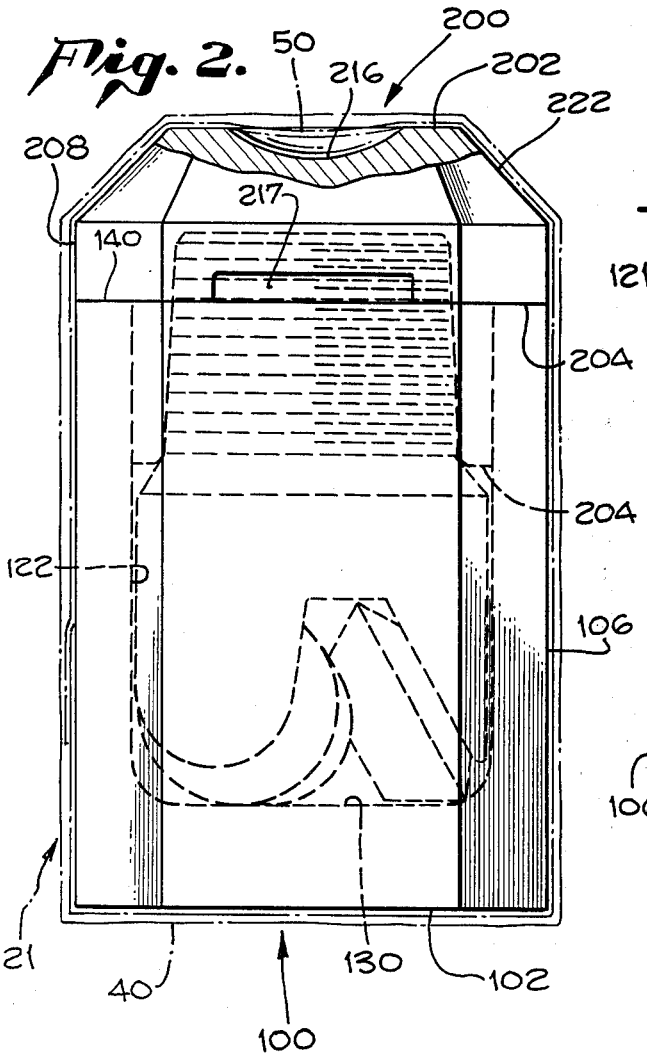
FIG. 2 is a side view of the preferred embodiment of the protective container package showing a rock drill bit assembly encased therein.
Figure 4:
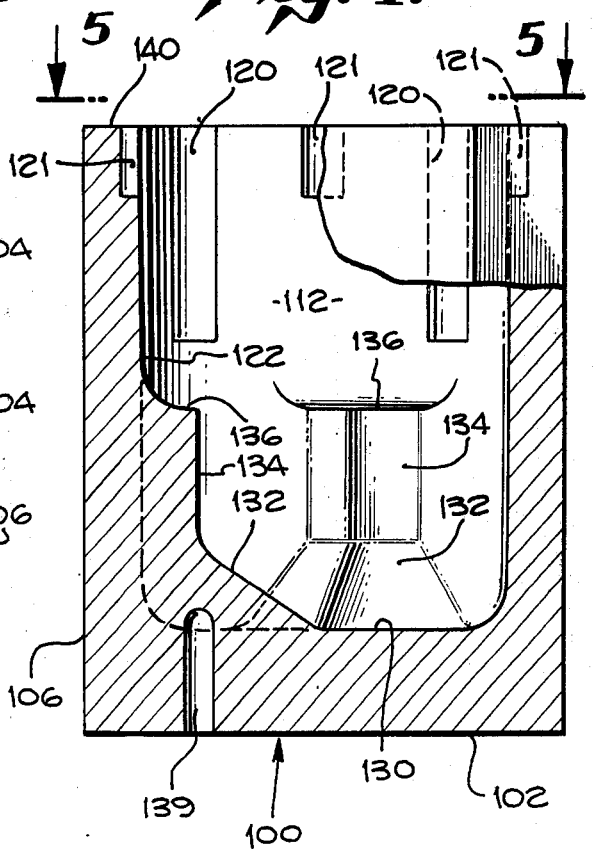
FIG. 4 is a cross-sectional side view of the preferred embodiment of the box container section.

Referring to FIGS. 1 through 8, inclusive, the present invention relates to a protective container package 20 for a rock drill bit assembly including a two piece container assembly 100, 200 having a cavity 112, 212 therein conforming to the rock drill bit assembly and securing it, a shrinkable envelope 40 shrunk around said container assembly 100, 200 thereby encapsulating it, and a band of plastic strapping 50 wrapped vertically around the encapsulated container package 21 to provide reinforcing means and to provide means for lifting and carrying said protective container package 20.

The two piece container assembly 100, 200 comprises a lower box container section 100 and an upper cover container section 200 each being integrally formed from a moldable rigid plastic material. The box section 100 has an exterior flat horizontal base 102 which is substantially octagonal in configuration with alternate edges approximately twice the length of adjoining edges. Vertical ascending walls 106 blend with and rise upward from the base thus defining an exterior peripheral octagonal wall surface 106 therearound forming therewithin a cavity 112 adapted to receive the bottom portion of a rock drill bit assembly. This internal cavity is longitudinally axially aligned within the box container section 100 and conforms to and will accept the exterior configuration of the bottom portion of a rock drill bit assembly, and in addition said internal cavity 112 has two series of longitudinally, surface recessed slots 120, 121 in its internal wall 122. One set of longitudinal slots 121 is adapted to receivably accept mating ridges 221 of the cover container section 200 so as to vertically and rotationally fix the mated relationship of the cover container section 200 to the box container section 100.

The second set of longitudinally recessed slots 120 are adapted to provide the box container section 100 with uniform cross-sectional walls locally reduced in thickness so as to facilitate the molding of same. The box container section upper surface 140 is horizontal and parallel to the exterior base surface 102, and is adapted to seat the cover container section 200 and to receivably accept the cover section 200 mating ridges 221. The bottom surface 130 of the box section internal cavity has three conformally shaped, equidistant symmetrically protruding, raised triangular gusset areas 132 adapted to receive the respective bottom surfaces of the rock drill bit assembly, and thus firmly support them. Vertical ascending triangular columns 134 rising from said gussets 132 and having a top surface 136 provide additional strength to the box section 100 interior cavity sidewalls 122 and conformally fit under the rock drill bit assembly jet bore shoulders to furnish further support to the product. Molding relief cylindrical blind holes 139 with ingress from exterior bottom base surface 102 are vertically positionally located within the gusset areas 132 and extend upward centrally into the ascending triangular columns 134 so as to further provide box container section 100 with walls of uniform cross-sectional thickness but locally reduced in thickness to facilitate molding.

The upper cover container section 200 has a top surface 202 parallel to its bottom base surface 204; a peripheral outer stepped edge surface 206 for defining the exterior octagonal wall 208, 222 of the container assembly cover section 200, for providing a horizontal flat ledge 210 for seating on the upper rim surface edge 140 of the box container section 100, and for forming a mating vertically descending longitudinally concentric circular wall section 214 which is adapted for positional alignment purposes to conformally protrude and to slidably fit into the box container section internal cavity 112; and within said cover container section 200 is an internal cavity 212 with its ingress opening defining a portion of the cover container section bottom base surface, and said internal cavity 212 being adapted to conformally accept the top portion of the rock drill bit assembly.

The cover container section 200 top surface 202 is a flat horizontal plane having on its surface 202 a concave dish-shaped depression 216 large enough to permit a person's hand to reach under an overlying strap 50 for lifting purposes. This top surface 202 is basically octagonal is shape with four alternate long sides 218 and four relativelly shorter sides 220. Descending sloping peripheral surfaces 222 are truncated and sloped away from these octagonal edges 218, 220 at approximately 45 degree angle thereby forming a sloped plane 222 to facilitate subsequent strap 50 banding operations and also reduce container material costs. As the peripheral sloped descending walls 222 fade away from the top cover surface 202, they blend into the vertical peripheral walls 208 forming the exterior octagonal vertical wall surface 208 of the cover 200, and said exterior wall surfaces 208 have depressions 217 therein which are adapted for lifting or carrying ease. Said exterior vertical peripheral octagonal walls 208 extend downward and join with a horizontal flat plane 210 extending inwardly and defining a seating surface where the cover 200 mates in face to face contact with the upper horizontal edge surface 140 of the box container section 100. Protruding downward vertically from this horizontal seating surface 210 is a longitudinally concentric circular hollow tubular section 226 with longitudinally extending protruding ridges 221 thereon its outer longitudinal wall 214 adapted to vertically and rotationally fix the position of the mated cover 200 with respect to the box container section 100, and containing vertical cavities 220, 250, 251 adapted to provide the cover container section 220 with uniform cross-sectional walls locally reduced in thickness to facilitate the molding of same. The bottom surface 204 of the cover defines a horizontal flat circular edge surface of the longitudinally concentric vertical descending wall section 226, which has a relatively thin wall section 227 sloping upward and inward and thereby forming a rim 229 which defines the entrance to the internal cavity 212 of the container cover section 200, said cavity 212 is conformally adapted to receivably accept the upper body portion of said rock drill bit assembly.

The mated box 100 and cover container sections 200 conform to the outer configuration of the rock drill bit assembly surface and thus sufficiently restrain and provide adequate protection thereto. Upon enclosure within the two piece container assembly, a shrinkable envelope 40 of relatively thin-wall plastic material capable of shrinking substantially upon the application of heat, is encased about the mated closed container assembly containing the rock drill bit assembly therein. Upon the application of heat, the envelope 40 shrinks and thereby conforms to the external configuration of the container assembly 100, 200, thereby encapsulating it and sealing it from external environs.

Thereafter, a suitable strapping 50 of a relatively flat, thin strap material is vertically wrapped around the encapsulated container thereby reinforcing and preventing separation of the two piece container assembly 100, 200 and also providing carrying means for lifting and transporting the protective container package 20.

OPERATION

The rock drill bit assembly is packaged prior to shipping by first placing it carefully into the box container section 100 so that the three triangular equidistant, symmetrically raised gusset surfaces 132 rising from the cavity interior base 130 will nest between the cones of the rock drill bit assembly cutting teeth. These raised triangular areas 132 function as gussets and also provide supports which are adapted to take the major load and to prevent the rock drill bit assembly from punching through the box container section base bottom 102. Vertically ascending triangular columns 134 rising from the gusset 132 upper surface provide additional strength to the box container section sidewalls 122 and fit under the rock drill bit assembly jet bore shoulder walls to add further support to the product.

The internal cavity 112 of the box container section 100 is conformally molded so as to conform to the exterior configuration of the rock drill bit assembly to prevent shifting and rotation of the rock drill bit assembly during transport and handling, and the wall sections 122 and the base section 102 are sufficiently thick to absorb dropping loads.

While the bottom portion of the rock drill bit assembly is fully encompassed by the box container section 100, the top portion of the rock drill bit assembly protrudes upward above the upper edge surface 140 of the box container section 100 and presents a conformal surface projecting upward adapted for acceptance of the cover container section 200. For further positive mating of the cover section 200 with the box container section 100, said box container section 100 has vertical elongated receiving slots 121 in its inner cavity 112 walls 122 with entry thereto in the upper top edge surface 140 and said slots 121 extending vertically downward and which are adapted to receive the respectively mating indexing ridges 221 of the cover container section 200. Molding relief holes 120, 139 are molded in the interior cavity wall 122 and in the interior of gusset 132 extending centrally upward into vertical support 134 to provide uniform cross-sectional thickness to facilitate molding of the box container section 100 and to reduce material costs for same. The box exterior side walls 106 are octagonal in number so as to give the box container section an external configuration which will prevent rolling of the packaged rock drill bit assembly if the package is laid on its side.

With the rock drill bit assembly protruding upward from the box container section 100 and with the box mating receiving recesses 121 ready to accept the cover container section 200, said cover container section 200 is ready for engagement with said mating components.

As the cover container section 200 is engaged with the box container section 100, the cover vertical descending circular concentric section 214 leading edges slides into the box container section internal cavity 112 and is guided into place by box container side wall 122. As the cover container section 200 continues to slidingly mate further into the box container cavity 112, a point of engagement is reached where the projecting ridges 221 on the vertical descending concentric circular surface 214 of the cover container section 200 mate with the receiving slot 121 within the cavity wall 122 of the box container section 100, in a vertical removably fixed, positionally aligned, mated relationship. Immediately prior to full engagement of the cover container assembly 200 with box container assembly 100, the cover bottom surface upward sloping edges 227, 253, 255 aligns the rock drill bit assembly upper body portion for final engagement placement within the cover container section inner cavity 212 and firmly wedge seats cover container inner cavity inner surface 253, 255 against the top of the rock drill bit assembly as concurrently the cover container surface 210 firmly seats against box container surface 140. Surfaces 229 and 254 complete the cover cavity wall.

Similar to the box container section 100, the cover container section 200 has vertical blind internal mold relief cavities 220, 250, 251 adapted to provide the cover container section 200 with uniform cross-sectional thickness to facilitate molding same.

Thus, the final mating engagement movement of the cover container section 200 to the box container section 100 fully encloses the rock drill bit assembly within a two piece container assembly 100, 200 so as to conformally enclose, secure and protect same.

Thereupon, a shrinkable envelope 40 is placed over the lower box container section 100 and its properly mated upper cover container section 200. The entire unit is then run through an oven set at a correct prescribed temperature setting, whereupon the plastic envelope 40 is shrunk to conform to the container assembly 100, 200, thereby encapsulating it and sealing it against environmental damage. A suitable strap 50 is then vertically wrapped around the encapsulated assembly for reinforcing and handling ease, and the protectively packaged rock drill bit assembly 20 is then ready for storage or shipment.

Handling of the protectively packaged rock drill bit assembly 20 is facilitated by a concave depression 216 in the top cover container section 100 upper top surface 202 which permits sufficient clearance between said surface 202 and said strap 50, so as to permit the insertion of a person's hand under the strap to facilitate handling the packaged rock drill bit assembly 20. Furthermore, exterior surface depressions 217 in the cover assembly section exterior surface 208 permit a person to grasp the rock drill bit assembly package 20 and handle it or lift it easily.

ALTERNATE FORMS

Figure 10:
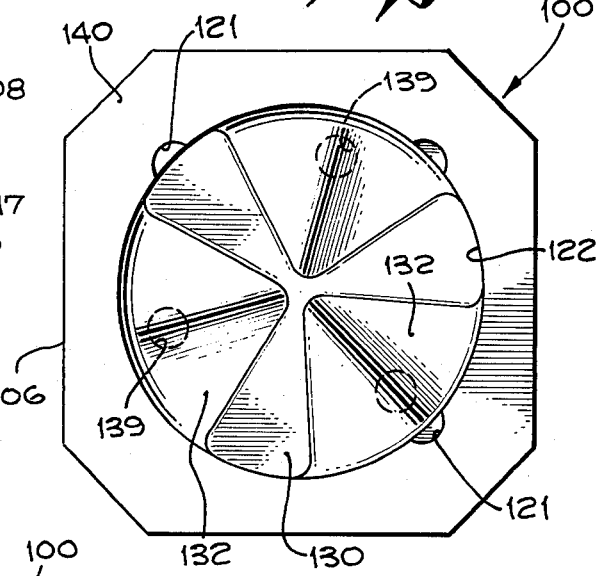
FIG. 10 is a top view of the box container section of said alternate form.
Figure 11:
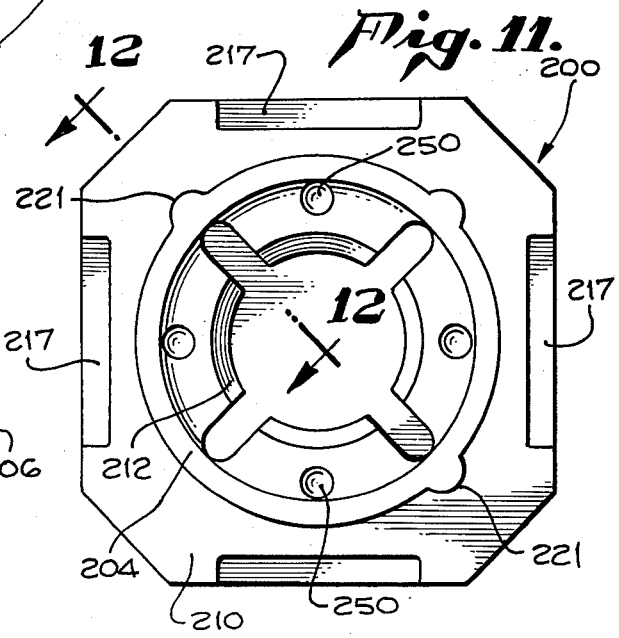
FIG. 11 is a bottom view of the cover container section of said alternate form.
Figure 12:
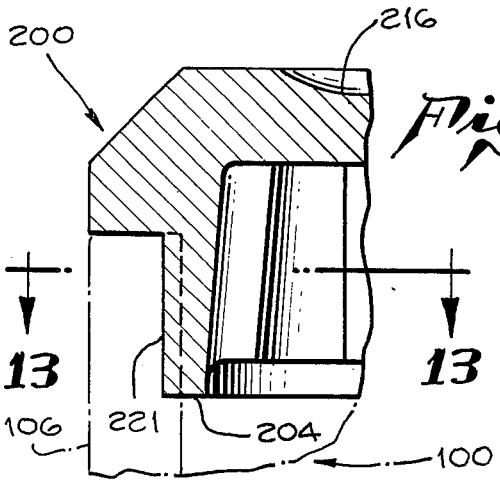
FIG. 12 is a fragmentary cross-sectional side view of a mated box and cover container section of an alternate form showing a cover indexing ridge mated in its respective box receiving slot, as referenced in FIG. 11, Section 12—12.
Figure 13:
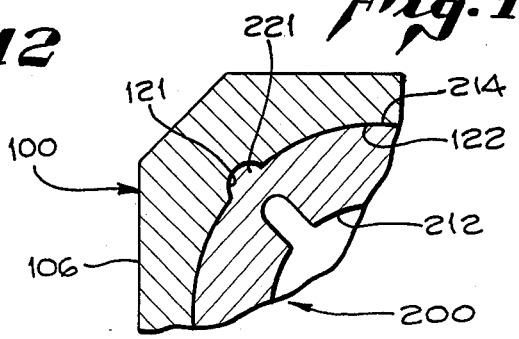
FIG. 13 is a fragmentary cross-sectional top view of a mated box and cover container section of an alternate form showing a cover indexing ridge mated in its respective box receiving slot, as referenced in FIG. 12, Section 13—13.

FIGS. 9 through 13, inclusive, illustrate an alternate form of the invention which has been used with some degree of success. The relative sizes and shapes of the container box 100 and the cover 200 are essentially the same as in the preferred embodiment. The box is shown in the lower half of FIG. 9 and in FIG. 10. The cover is shown in the upper half of FIG. 9 and in FIG. 11. FIGS. 12 and 13 illustrate the interengagement of the box and cover.

Figure 9:
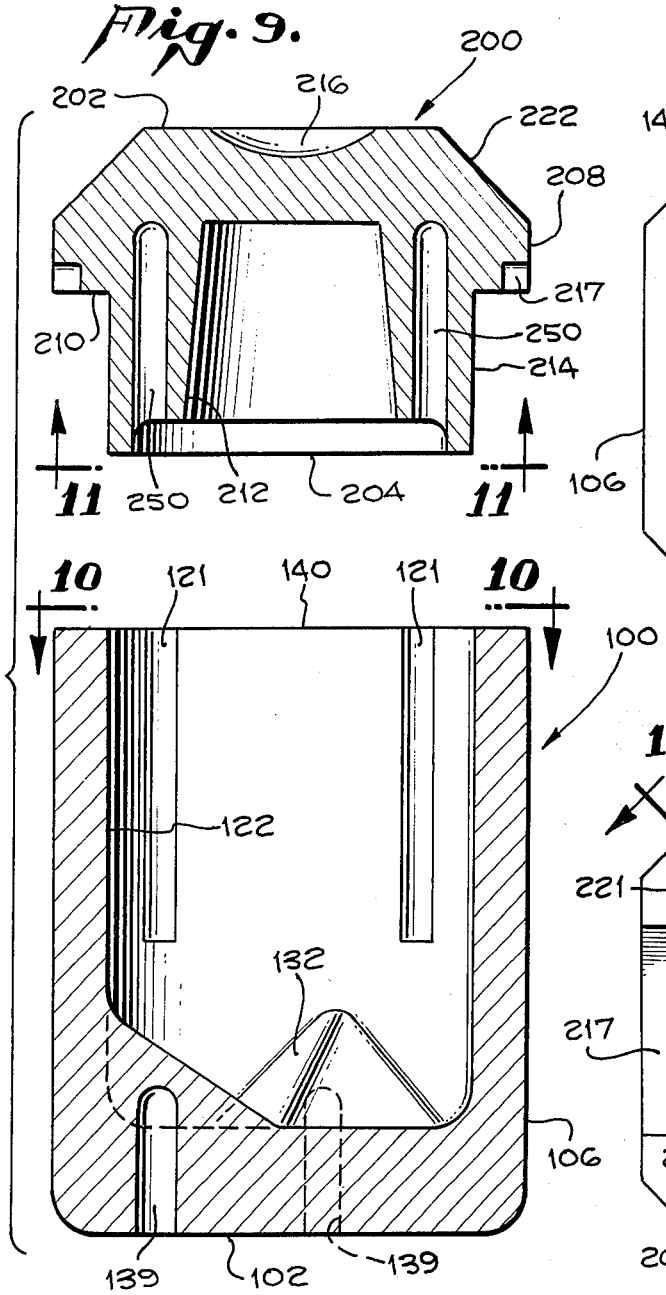
FIG. 9 is a cross-sectional view of the box and of the cover container sections of an alternate form of the protective container package.

Box 100 as shown in FIGS. 9 and 10 includes three of the gussets 132, but does not include the ascending columns 134 of the prior embodiment. The mold relief recesses 120 are not included. There are only three of the slots 121 (FIG. 10) formed in the cylindrical wall surface 122. The slots 121 are adjacent the beveled corners of the box rather then being in the centers of its longitudinal sides.

Cover 200 is shown in FIGS. 9 and 11. Mold relief recesses 220 are not included. There are only three of the ridges 221, and they are located adjacent the beveled corners of the cover, rather than being in the longitudinal centers of its flat side edges. Depression 216 on the top surface of the cover is included, as in the other embodiment. The central recess or cavity 212 on the under side of cover 200 has the form of a truncated cone, as in the other embodiment, but also includes a set of four rather deep notches in its circumferential wall spaced at 90° locations, as shown in FIGS. 11 and 13, to increase the ease of molding the product. Three of these indentations are in precise alignment with the corresponding ridges 221 (FIG. 13).

While the preferred presently illustrated container exterior vertical surface 106 is substantially octagonal in cross-section peripheral surface, it will be readily appreciated that the present invention would work equally as well if it were circular, oval shaped, or if it were of many myriad shapes and designs. Also, the indexing method could assume other configurations such as alternate keying or mating ridge arrangements wherein the cover 200 could only mate to the box container section 100 in one fixed vertical and rotational position. Filler pieces of various sizes and shapes could be inserted or a fluidized, quick-set foam can be sprayed between the rock bit drill assembly and the box container section 100 inner cavity wall 112 so as to further protect or positionally fix the position of an irregularly shaped rock drill bit assembly where it may be difficult or costly to design the box container section 100 inner cavity wall 112 to fully conform to same. Thus, it is obvious that the conformal configuration of the common internal cavity 112, 212 can be altered to suit a particular rock drill bit assembly to be encapsulated. Furthermore, it is evident that mold relief core sections 120, 139, 220, 250, 251 in the box 100 and cover 200 container sections can be of multiple variety of sizes and shapes to facilitate uniform cross-sectional wall thickness for molding purposes.

Various encapsulating methods other than shrinkable plastic sheet 40 may be used to encapsulate the container assembly 100, 200. The flexible strapping 50 thereafter wrapped around the encapsulated container assembly can be made of steel, plastic or other suitable material, and would equally as well perform its function of reinforcing the container assembly and facilitating the handling of the protective container package 20.

In addition, the recessed surfaces 216, 217 in the container assembly exterior surface can be altered and thus modified to facilitate handling without changing their functional intent.

The invention has been described in considerable detail in order to comply with the patent laws by providing full disclosure of at least one of the preferred forms of the present invention. However, such detailed description is not intended in any way to limit the broad features of the principles of said invention, or the scope of patent monopoly.

What is claimed is:

1. A two piece shipping container made of molded rigid plastic material, comprising:

a box having a bottom wall portion and a contiguous peripherally extending side wall portion forming a central cavity therein, the configuration of said side wall portion in the horizontal plane being generally octagonal on its exterior surface and generally cylindrical on its interior surface, said box having a set of three gussets within said central cavity rising up from said bottom wall at 120 degree intervals thereon, said box also having formed in the upper extremity of the inner surface of said side wall portion a plurality of vertical grooves which are spaced at 90° intervals thereon; and a cover including a base portion whose external surface configuration in the horizontal plane conforms to that of said box, a truncated pyramidal dome rising upwardly from said base portion, and a cylindrical flange portion formed integral with said base portion and depending downwardly therefrom, the external cylindrical surface of said flange portion being adapted for sliding insertion with the cylindrical cavity of said box, and having a plurality of vertically extending ridges formed thereon for sliding engagement within said grooves of said box, said cover also having an interior cavity in the center of said base portion thereof and whose diameter is less than the diameter of said box cavity;

said cover being characterized by a plurality of horizontally extending recesses formed in its exterior lower surface, for finger gripping purposes, said recesses being circumferentially spaced on said cover;

said cover being further characterized by a depression formed in the upper flat surface of said pyramidal dome, said depression being large enough for insertion of several fingers therein. a

2. The container of claim 1 having vertical columns which rise above said gussets.

3. The container of claim 1 having four of said grooves in said box, and four of said ridges in said cover.

4. The container of claim 1 wherein the exterior surface of said box is not a regular octagon, but has flat sides which are twice as long as beveled corners between said sides.

5. The container of claim 4 wherein said box grooves are in the centers of the flat sides thereof.

6. The container of claim 4 wherein the hand grip recesses are in the flat sides of the cover.

7. The container of claim 1 wherein said interior cavity of said cover rises above said finger gripping recesses.

8. A packaged rock drill bit assembly comprising:

a two-piece shipping container made of molded plastic material including a box having a central cavity therein and a plurality of gussets disposed around the lower periphery of said central cavity, a cover having a downwardly depending cylindrical flange adapted for vertical sliding insertion within said box cavity, and means provided on said box and said cover for rotationally indexing said cover to said box;

a rock drill bit assembly having a lower portion of relatively greater diameter disposed within said box cavity, and an upper portion of relatively lesser diameter disposed within said cover flange, said lower portion having bottom surfaces received upon and supported by respective ones of said gussets;

a relatively thin heat shrinkable plastic envelope disposed about said container and being shrunk thereupon;

a strap wrapped vertically about said container and plastic envelope; and said container cover having a recess in its upper surface beneath said strap;

whereby said strap may be utilized for lifting said container, and a person's fingers may then be inserted under said strap and within said recess.

9. A packaged rock drill bit assembly as in claim 8 wherein there are three of said gussets.

10. A packaged rock drill bit assembly as claimed in claim 8 wherein the side wall of said box is of generally octagonal configuration on its exterior surface and generally cylindrical on its interior surface.

11. A packaged rock drill bit assembly as in claim 8 wherein said indexing means includes a plurality of circumferentially arranged, vertically extending grooves formed in one of said box and cover, and a plurality of mating, vertically extending ridges formed on the other thereof.

12. A packaged rock drill bit assembly as in claim 8 wherein said cover is characterized by a plurality of horizontally extending recesses formed in its exterior lower surface, for finger gripping purposes, said recesses being circumferentially spaced on said cover.

13. A packaged rock drill bit assembly as in claim 8 wherein said cover has an interior cavity therein which rises above the upward extension of said cylindrical flange.

* * * * *